US007677123B2

(12) United States Patent
Nawa

(10) Patent No.: US 7,677,123 B2
(45) Date of Patent: Mar. 16, 2010

(54) IMPACT ABSORBING DEVICE

(75) Inventor: Yukio Nawa, Gifu (JP)

(73) Assignee: Denso Corporation, Kariya (JP)

( * ) Notice: Subject to any disclaimer, the term of this patent is extended or adjusted under 35 U.S.C. 154(b) by 126 days.

(21) Appl. No.: 11/898,868

(22) Filed: Sep. 17, 2007

(65) Prior Publication Data

US 2008/0087134 A1 Apr. 17, 2008

(30) Foreign Application Priority Data

Oct. 13, 2006 (JP) ..... 2006-280014

(51) Int. Cl.
*F02M 1/00* (2006.01)

(52) U.S. Cl. ..... 74/7 C; 74/6; 192/56.61; 464/37

(58) Field of Classification Search ..... 74/7 A, 74/7 C, 7 E, 7 R, 6; 464/10, 45–48, 37; 192/56.6, 192/56.61
See application file for complete search history.

(56) References Cited

U.S. PATENT DOCUMENTS 3,319,751 A * 5/1967 Sacchini ..... 192/48.3
4,192,195 A * 3/1980 Kazino et al. ..... 74/7 A
6,190,254 B1 * 2/2001 Bennett ..... 463/13
6,572,479 B1 * 6/2003 Saito et al. ..... 464/46
2005/0076727 A1 4/2005 Hasegawa et al.

FOREIGN PATENT DOCUMENTS

JP A-2005-113816 4/2005

* cited by examiner

*Primary Examiner*—David M Fenstermacher
(74) *Attorney, Agent, or Firm*—Oliff & Berridge, PLC

(57) ABSTRACT

An impact absorbing device has fixed discs and rotary discs alternately and coaxially disposed. Each disc has two surfaces, and two surfaces of each pair of fixed and rotary discs face each other through a lubricant. Each surface has dimples, respectively, surrounded by concave portions. A position of each dimple in the rotary discs is differentiated from a position of any dimple of the fixed discs in a radial direction of the discs. In response to an impact given to the rotary discs, the rotary discs are rotated on the fixed discs against a frictional force between the discs to absorb the impact. During this rotation, each dimple of the rotary discs is moved along a circumferential direction of the discs, and no concave portions of the rotary discs are placed just on the concave portions of the fixed discs.

11 Claims, 9 Drawing Sheets

IMPACT ABSORBING DEVICE

CROSS-REFERENCE TO RELATED APPLICATION

This application is based upon and claims the benefit of priority of the prior Japanese Patent Application 2006-280014 filed on Oct. 13, 2006 so that the contents of which are incorporated herein by reference.

BACKGROUND OF THE INVENTION

1. Field of the Invention

The present invention generally relates to a multiple disc type impact absorbing device which absorbs an impact generated when a starter starts a driving operation of an engine.

2. Description of Related Art

When a starter starts a driving operation of an internal combustion engine, a driving torque of a motor is transmitted from an armature shaft to a ring gear of the engine through a pinion gear to crank the engine. At the cranking time of the engine, an impact force caused by a collision of the pinion gear with the ring gear is generated in the pinion gear and is transmitted to the armature shaft through a speed reducer. The starter has an impact absorbing device to absorb this impact force. For example, Published Japanese Patent First Publication No. 2005-113816 discloses a multiple disc type impact absorbing device of a starter.

In this device, a plurality of fixed discs and a plurality of rotary discs are alternately disposed so as to place each rotary disc between two fixed discs. The centers of the discs are placed on a common center axis. Each disc has an uneven surface acting as a frictional surface on each of both sides. A cone disc spring gives a pushing force to a laminator of the discs such that a static friction is generated between the frictional surfaces of each pair of fixed and rotary discs facing each other through an oil film of lubricant. Each rotary disc is fixedly joined to an internal gear of a planetary gear type speed reducer. Each fixed disc is supported by a case so as not to be rotated. When a load torque exceeding a slipping torque corresponding to the static friction is given from a pinion gear to the rotary discs through the internal gear as an impact force, each rotary disc slips on the adjacent fixed discs against the static friction and is rotated with the internal gear. Because the impact force is lost during the rotation of the rotary discs by sliding friction between the discs, the impact force is absorbed in the impact absorbing device to prevent the impact force from exerting an adverse influence on the reducer and/or the motor.

Each of the frictional surfaces of the fixed and rotary discs has a large number of dimples or concave portions formed by a stamping work, and lubricant is coated on the frictional surfaces and is held in the dimples. Therefore, the lubricant supplied from the dimples to a space between the frictional surfaces suppresses the generation of seizure on the frictional surfaces so as to prevent the discs from seizing up. Accordingly, the lubricant acts to prolong a life of the impact absorbing device.

When the rotary and fixed discs are punched by a pressing machine to form dimples on the frictional surfaces, the disc substance punched is moved as a fluid matter so as to rise up around each dimple. Therefore, a convex portion or a rising portion is formed around each dimple. In the device disclosed in the Publication, the dimples in each disc are arranged in a matrix shape at a fixed pitch along a radial direction of the disc and a circumferential direction perpendicular to the radial direction. The dimples in the rotary discs are placed in the radial direction at the same positions as the dimples of the fixed discs are placed.

With this arrangement of the dimples, when the rotary discs are rotated on the fixed discs, the dimples in each rotary disc are moved along the circumferential direction of the disc. Because the positions of the dimples in the rotary discs in the radial direction are the same as the positions of the dimples in the fixed discs, each dimple of the rotary discs passes on each of the corresponding dimples of the fixed discs placed in the radial direction at the same position as the position of the each dimple. Therefore, there is a high probability that the convex portion of each dimple of the rotary discs may periodically and directly come in contact with each of the convex portions of the corresponding dimples of the fixed discs without placing an oil film of lubricant between the convex portions of the dimples of the rotary and fixed discs. This direct contact increases abrasion between the convex portions. When this abrasion is continued, the convex portions are cut and planed, and flattened frictional surfaces of the rotary discs directly come in contact with those of the fixed discs. When this direct contact of the flattened frictional surfaces is frequently caused, a period of the direct contacts between the rotary discs and the fixed discs without any lubricant is lengthened.

As a result, the frictional surfaces of the discs partially seize up or are burned, and the slipping torque between the discs become unstable so as to change a rotational speed of the rotary discs with time. Finally, there is a high probability that the rotary discs may be locked due to the seizure of the discs. In other words, even when a driving torque is excessively transmitted to the rotary discs, the rotary discs cannot be rotated, and the impact absorbing device malfunctions.

SUMMARY OF THE INVENTION

An object of the present invention is to provide, with due consideration to the drawbacks of the conventional impact absorbing device, an impact absorbing device which reliably absorbs an impact force by a frictional force acting between fixed and rotary discs for a long time while stabilizing a slipping torque of the rotary disc.

According to a first aspect of this invention, the object is achieved by the provision of an impact absorbing device comprising a fixed disc with a first frictional surface, and a rotary disc with a second frictional surface coaxially facing the first frictional surface of the fixed disc. The fixed disc has a plurality of first dimples on the first frictional surface. The rotary disc has a plurality of second dimples on the second frictional surface. A position of each second dimple is set to be differentiated from a position of any of the first dimples in a radial direction of the discs.

With this structure, when a load torque is given to the rotary disc as an impact force, the rotary disc is rotated on the fixed disc against a frictional force between the fixed disc and the rotary disc, and each of the second dimples is moved along a circumferential direction of the discs substantially perpendicular to the radial direction. Because a position of each second dimple is differentiated from any of the first dimples in the radial direction, no second dimple is placed just on the first dimples.

Therefore, when each of the dimples has a convex portion around the dimple, a probability that the convex portion of each second dimple periodically comes in contact with the convex portions of the first dimples is reduced. As a result, even when the rotary disc is rotated on the fixed disc for a long time, the convex portions of the dimples reliably remain on the frictional surfaces so as to stabilize a slipping torque of the rotary disc.

Accordingly, the device can reliably absorb an impact force by a frictional force acting between fixed and rotary discs for a long time while stabilizing a slipping torque between discs.

Further, when each of the frictional surfaces is coated with a lubricant, each second dimple periodically comes in contact with the convex portions of the first dimples through an oil film of the lubricant. Therefore, the device can further reliably absorb an impact force.

According to a second aspect of this invention, the object is achieved by the provision of an impact absorbing device comprising the fixed disc with the first dimples and the rotary disc with the second dimples. The first dimples form a plurality of blocks aligned with one another along a circumferential direction of the discs, and the first dimples of each block are arranged substantially at a first equal pitch along a radial direction of the discs. The second dimples form a plurality of blocks aligned with one another along the circumferential direction, and the second dimples of each block are arranged substantially at a second equal pitch different from the first equal pitch along a radial direction of the discs.

With this structure, because the pitch of the second dimples in the radial direction differs from the pitch of the first dimples, there is a high probability that a position of each second dimple in the radial direction can be differentiated from a position of any first dimple. Therefore, when each of the dimples has a convex portion around the dimple, a probability that the convex portion of each second dimple periodically comes in contact with the convex portions of the first dimples is reduced.

Accordingly, the device can reliably absorb an impact force by a frictional force acting between fixed and rotary discs for a long time while stabilizing a slipping torque between discs.

According to a third aspect of this invention, the object is achieved by the provision of an impact absorbing device comprising the fixed disc with the first dimples and the rotary disc with the second dimples. The first dimples form a plurality of blocks aligned with one another along a first direction inclined with respect to a radial direction of the discs, and the first dimples of each block are arranged at an equal pitch along a second direction substantially perpendicular to the first direction. The second dimples form a plurality of blocks aligned with one another along a third direction differentiated from the first and second directions and inclined with respect to a radial direction of the discs, and the second dimples of each block are arranged along a fourth direction substantially perpendicular to the third direction at the same equal pitch as the first dimples of each block are arranged.

With this structure, because an extending direction of each block of second dimples differs from an extending direction of any block of first dimples, a pitch of the second dimples in the radial direction differs from a pitch of the first dimples. In this case, a position of each second dimple in the radial direction can be differentiated from a position of any first dimple at a high probability. Therefore, when each of the dimples has a convex portion around the dimple, a probability that the convex portion of each second dimple periodically comes in contact with the convex portions of the first dimples is reduced.

Accordingly, the device can reliably absorb an impact force by a frictional force acting between fixed and rotary discs for a long time while stabilizing a slipping torque between discs.

According to a fourth aspect of this invention, the object is achieved by the provision of an impact absorbing device comprising the fixed disc with the first dimples and the rotary disc with the second dimples. The first dimples have a shape or size differentiated from a shape or size of the second dimples to differentiate a position of a part of each second dimple in a radial direction of the discs perpendicular to the circumferential direction from a position of any of the first dimples.

With this structure, when each of the dimples has a convex portion around the dimple, a probability that the convex portion of each second dimple periodically comes in contact with the convex portions of the first dimples is reduced. Accordingly, the device can reliably absorb an impact force by a frictional force acting between fixed and rotary discs for a long time while stabilizing a slipping torque between discs.

According to a fifth aspect of this invention, the object is achieved by the provision of an impact absorbing device comprising the fixed disc with the first dimples and the rotary disc with the second dimples. The first dimples are arranged in a first arranging pattern, and the second dimples are arranged in a second arranging pattern. The first arranging pattern of the first dimples is differentiated from the second arranging pattern of the second dimples to differentiate positions of a part of the second dimples in a radial direction of the discs perpendicular to the circumferential direction from positions of a part of the first dimples.

With this structure, when each of the dimples has a convex portion around the dimple, a probability that the convex portion of each second dimple periodically comes in contact with the convex portions of the first dimples is reduced. Accordingly, the device can reliably absorb an impact force by a frictional force acting between fixed and rotary discs for a long time while stabilizing a slipping torque between discs.

DETAILED DESCRIPTION OF THE PREFERRED EMBODIMENTS

Figure 1:
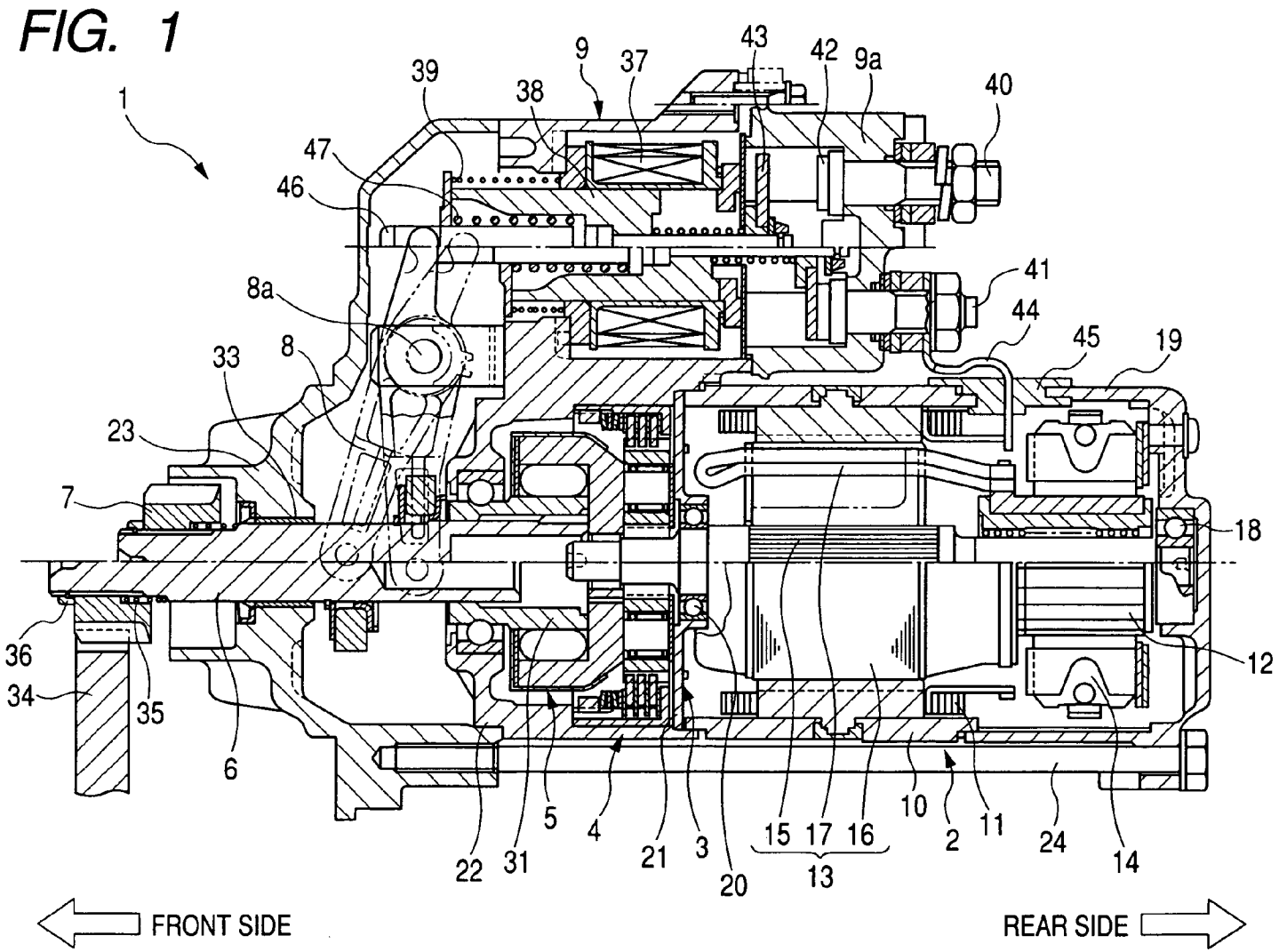
FIG. 1 is a longitudinal sectional view of a starter with an impact absorbing device according to a first embodiment of the present invention.

Embodiments of the present invention are now described with reference to the accompanying drawings, in which like reference numerals indicate like parts, members or elements throughout the specification unless otherwise indicated.

Embodiment 1

Figure 2:
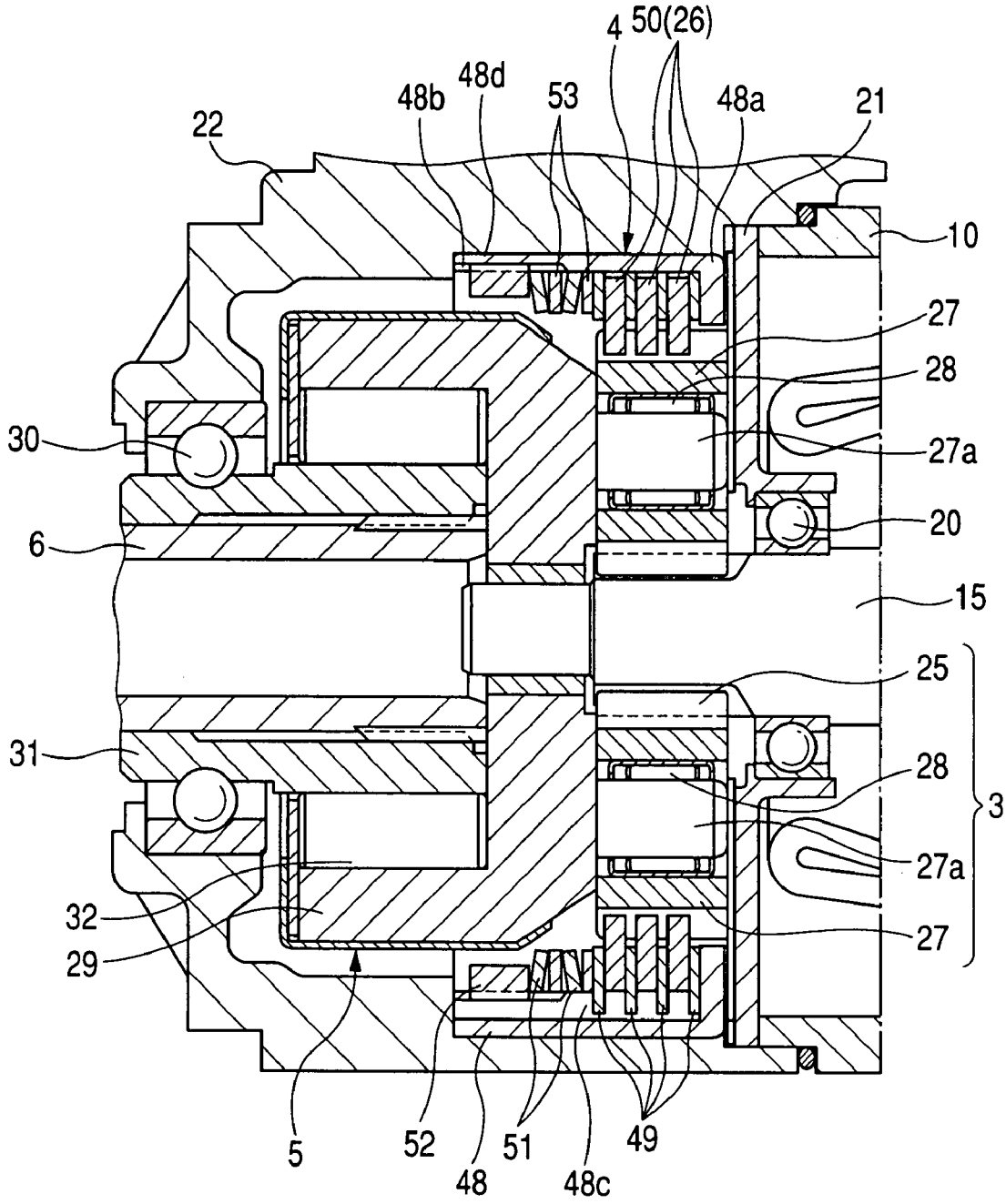
FIG. 2 is an enlarged sectional view of the impact absorbing device, a speed reducer and a clutch of the starter shown in FIG. 1.

FIG. 1 is a longitudinal sectional view of a starter with an impact absorbing device according to the first embodiment, while FIG. 2 is an enlarged sectional view of the impact absorbing device, a speed reducer and a clutch of the starter shown in FIG. 1. A starter 1 shown in FIG. 1 starts a driving operation of an internal combustion engine (not shown) of a vehicle.

As shown in FIG. 1, the starter 1 has a direct current (DC) motor 2 generating a rotational force (i.e., driving torque) at a high rotational speed, a planetary gear type speed reducer 3 reducing the rotational speed of the rotational force transmitted from the motor 2, an impact absorbing device 4 structured in combination with the speed reducer 3, a one-way clutch 5, a pinion shaft 6 connected with the speed reducer 3 through the clutch 5, a pinion gear 7 supported by the pinion shaft 6, and an electromagnetic switch 9 opening and closing a main contact point of an energizing circuit (hereinafter, called a motor circuit) of the motor 2 and giving a moving force to the pinion shaft 6 through a shift lever 8 to move the pinion shaft 6 in an axial direction of the motor 2. In FIG. 1, an upper half view of the pinion shaft 6 above a center line CL1 and an upper half view of the switch 9 above a center line CL2 show a non-operation state of the starter 1, and a lower half view of the pinion shaft 6 below the center line CL1 and a lower half view of the switch 9 below the center line CL2 show a start operation state of the starter 1.

The motor 2 has a cylindrical yoke 10, a plurality of field coils 11 (permanent magnets are applicable in place of the coils 11) disposed on an inner circumferential surface of the yoke 10, an armature 13 with a rectifier 12, and a brush 14 being in contact with and sliding on the surface of the rectifier 12. An operation of the motor 2 is well known and is omitted.

The armature 13 has an armature core 16, an armature shaft 15 inserted into a center space of the core 16 to be serration-connected with the core 16, and an armature coil 17 wound around the core 16. The coil 17 is connected with segments of the rectifier 12. A rear end portion of the shaft 15 is protruded from the rectifier 12 toward a rear side of the starter 1 and is supported by an end frame 19 through a bearing 18. A front end portion of the shaft 15 is protruded from the core 16 toward a front side of the starter 1 and is supported by a center plate 21 through a bearing 20.

As shown in FIG. 1 and FIG. 2, the plate 21 is disposed between the armature 13 and the reducer 3. The plate 21 extends in perpendicular to the shaft 15 to prevent foreign matters such as powder particles from flying from the brush 14 and being scattered toward the reducer 3. An outer circumferential portion of the plate 21 is placed between a center case 22 and the yoke 10. A front housing 23 covers a front portion of the starter 1, and the case 22 is disposed between the yoke 10 and the housing 23. The case 22, the yoke 10 and the frame 19 are fastened and fixed to the housing 23 through a plurality of through bolts 24.

The reducer 3 is disposed coaxially with the shaft 15 on the front side of the armature 13. The reducer 3 has a sun gear 25, an internal gear 26, and a plurality of planetary gears 27. The sun gear 25 is fixed to an end portion of the shaft 15 protruded from the plate 21. The internal gear 26 is disposed coaxially with the sun gear 25 so as to surround the sun gear 25. The plural planetary gears 27 are disposed at predetermined intervals between the sun gear 25 and the internal gear 26 so as to mesh with the sun gear 25 and the internal gear 26. The rotation of the internal gear 26 on the shaft 15 is restricted by the impact absorbing device 4. Each planetary gear 27 revolves around the sun gear 25 in response to the rotation of the sun gear 25, and the revolution of the planetary gears 27 is transmitted to the pinion shaft 6 through the clutch 5. Each planetary gear 27 is rotatively supported by a planetary pin 27*a* through a bearing 28 such as a needle bearing. The pin 27*a* is pressed into a clutch outer 29 of the clutch 5 to be fixed to the outer 29.

Therefore, the sun gear 25 is rotated in response to the rotation of the shaft 15 receiving a driving torque of the motor 2, the planetary gears 27 revolve around the sun gear 25 in response to the rotation of the gear 25 at a rotational speed lower than that of the shaft 15, and the driving torque of the motor 2 having a reduced rotational speed is transmitted from the gears 27 to the shaft 6 through the clutch 5.

The clutch 5 is disposed between the reducer 3 and the shaft 6. The clutch 5 has the clutch outer 29 receiving a driving torque of the motor 2 through the reducer 3, an inner tube 31 rotatively supported by the case 22 through a bearing 30, and a roller 32 disposed in a cam chamber formed in an inner space of the outer 29. The roller 32 transmits the driving torque of the motor 2 from the clutch outer 29 to the inner tube 31 and prevents a torque received from the inner tube 31 from being transmitted to the clutch outer 29. Therefore, the clutch 5 acts as a one-way clutch transmitting the driving torque of the motor 2 to the pinion shaft 6 and preventing a torque received from the shaft 6 from being transmitted to the motor 2.

The pinion shaft 6 is disposed coaxially with the armature shaft 15. One end of the shaft 6 is rotatively and slidably supported by the housing 23 through a bearing 33, and another end of the shaft 6 is inserted into a center hole of the inner tube 31 so as to connect the shaft 6 with the tube 31 in a helical spline coupling.

The pinion gear 7 is serration-fitted to a front end portion of the shaft 6 protruded from the bearing 33 toward the front side. The pinion gear 7 is biased toward the front side by a pinion spring 35 disposed on an inner circumferential surface of the pinion gear 7 so as to be positioned by a stopper 36 disposed at a top end of the shaft 6. When the starter 1 is operated, the pinion gear 7 is moved by the lever 8 toward the front side along the axial direction so as to mesh with a ring gear 34 of an engine and to transmit a driving torque of the motor 2 to the ring gear 34. Therefore, the driving operation of the engine is started.

The electromagnetic switch 9 has a cylindrical electromagnetic coil 37 and a plunger 38 disposed in a center space of the coil 37 to be movable along the axial direction. When the coil 37 receives an electric current supplied from a battery (not shown) in response to an operation start signal, the coil 37 forms an electromagnet, and the plunger 38 is attracted by the electromagnet so as to move the plunger 38 toward the read side along the axial direction against a biasing force of a return spring 39. In response to the movement of the plunger 38, a main contact point of a motor circuit is closed to supply an electric power from a battery to the motor 2 through the main contact point. In contrast, when the supply of the current to the coil 37 is stopped, the attraction of the electromagnet disappears, the plunger 38 is pushed back toward the front side by the spring 39, and the main contact point is opened to electrically disconnect the motor 2 from the battery.

The main contact point has two fixed contact points 42 and a movable contact point 43 movable with the plunger 38 to electrically connect and disconnect the points 42 with/from each other. One contact point 42 is connected with a battery of the vehicle through a B terminal 40 and a battery cable (not shown). The other contact point 42 is connected with a terminal 44 of the motor 2 through an M terminal 41. The terminals 40 and 41 are fixed to a resin cover 9*a* of the switch 9. The terminal 44 is held by a grommet 45 fixedly disposed between the yoke 10 and the frame 19. An end of the terminal 44 is connected with the coil 11. The main contact point is closed when the contact points 42 are electrically connected with each other. The main contact point is opened when the contact points 42 are disconnected from each other.

The shift lever 8 has a lever supporting point 8*a* supported rockably. One end portion of the lever 8 is coupled with a shift rod 46 of the switch 9. The rod 46 is attached to the plunger 38 through a drive spring 47. Another end portion of the lever 8 is coupled with the shaft 6. When the plunger 38 is moved toward the rear side by the attraction force of the electromagnet, the movement of the plunger 38 is transmitted to the lever 8 through the spring 47, and the shaft 6 is pushed toward the front side by the lever 8. In contrast, when the plunger 38 is pushed back toward the front side, the lever 8 receiving the movement of the plunger 38 through the spring 47 moves the shaft 6 toward the rear side.

Next, an operation of the starter 1 is described.

When a start switch such as an ignition switch (not shown) is turned on, the coil 37 of the switch 9 receives an electric current and attracts the plunger 38 toward the rear side, and the lever 8 pushes the pinion shaft 6 toward the front side in response to the movement of the plunger 38. Because the shaft 6 is coupled with the inner tube 31 in the helical spline, the shaft 6 is moved with the pinion gear 7 toward the ring gear 34 (i.e., toward front side) while being rotated on its axis. Then, a front side surface of the pinion gear 7 comes in contact with a rear side surface of the ring gear 34, the pinion gear 7 is still pressed on the ring gear 34 while contracting the pinion spring 35, and the movement of the shaft 6 and the pinion gear 7 is once stopped with the contracted spring 35.

The plunger 38 of the switch 9 is still moved to close the main contact point of the switch 9, and an electric power is supplied from a battery to the motor 2 through the contact points 42 and 43 and the terminal 44. Therefore, a rotational force is generated in the armature 13. Then, a rotational speed of the rotational force is reduced in the reducer 3, and the rotational force having the reduced speed is transmitted to the shaft 6. Therefore, the shaft 6 is compulsorily rotated with the pinion gear 7 so as to move the pinion gear 7 on the rear end surface of the ring gear 34. When the rotated gear 7 reaches an in-mesh possible position of the ring gear 34, the pinion gear 7 is moved into a center space of the ring gear 34 by a contracted force of the pinion spring 35 so as to be engaged with the ring gear 34 and to rotate the ring gear 34 with the pinion gear 7. Therefore, a rotational speed of a driving torque generated in the motor 2 is reduced in the reducer 3, the driving torque having the reduced rotational speed is transmitted to the ring gear 34 through the shaft 6 and the pinion gear 7, and the clanking of the engine is obtained.

At the clanking time, gear teeth of the pinion gear 7 heavily collide with those of the ring gear 34 to rotate the ring gear 34 with the gear 7, so that an impact force is generated in the gear 7. This impact force of the gear 7 is transmitted to the shaft 6, the inner tube 31, the roller 32, the clutch outer 29, the planetary pins 28, the planetary gears 27 and the internal gear 26, in that order. When the impact force exceeds a predetermined level, the impact absorbing device 4 absorbs the impact force to prevent the impact force from exerting an adverse influence on the reducer 3 and/or the motor 2.

When the driving operation of the engine is started, the start switch is turned off. Therefore, the supply of the electric current to the coil 37 is stopped, and the attraction of the electromagnet disappears. In response to this disappearance, the plunger 38 is pushed back toward the front side by the contracted spring 39 so as to disconnect the movable contact points 43 from the fixed contact point 42, and the power supply from the battery to the motor 2 is stopped. Therefore, a rotational speed of the armature 13 is gradually reduced, and the rotation of the armature 13 is finally stopped.

Further, in response to the movement of the plunger 38, the pinion shaft 6 is pushed back toward the rear side by the lever 8. Therefore, the pinion gear 7 is detached from the ring gear 34.

Next, the impact absorbing device 4 is described in detail.

As shown in FIG. 2, the device 4 has a plurality of fixed discs 49 and a plurality of rotary discs 50 alternately and coaxially disposed along the axial direction so as to place each rotary disc 50 between two fixed discs 49, a cylindrical case 48 wherein the discs 49 and 50 are accommodated, two cone disc springs 51 disposed on the front side of the discs 49 and 50, and a plurality of nuts 52 fixing the springs 51. Each of the discs 49 and 50 is disposed coaxially with the shaft 15 on the outer circumferential side of the reducer 3.

The case 48 is fixed to the inner circumferential surface of the center case 22 so as not to be rotated around the shaft 15. The case 48 has a cylindrical base body 48*d* and a ring-shaped bottom plate 48*a*. The bottom plate 48*a* extends from the base body 48*d* and is bent toward the shaft 15. An inner diameter of the plate 48*a* is set so as not to collide with the planetary gears 27. The case 48 has a plurality of female threads 48*b* and a plurality of grooves 48*c* in the body 48*d*. The nuts 52 are fixedly inserted into the threads 48*b*. The fixed discs 49 are fixedly engaged with the grooves 48*c*.

Each of the discs 49 and 50 is formed by shaping a metallic plate in a ring by press molding. The discs 49 and 50 are alternately stacked one by one to form a laminator in the case 48. Two fixed discs 49 are disposed on both ends of the laminator, respectively. The fixed disc 49 placed on the rear end abuts against the plate 48*a*.

Figure 3:
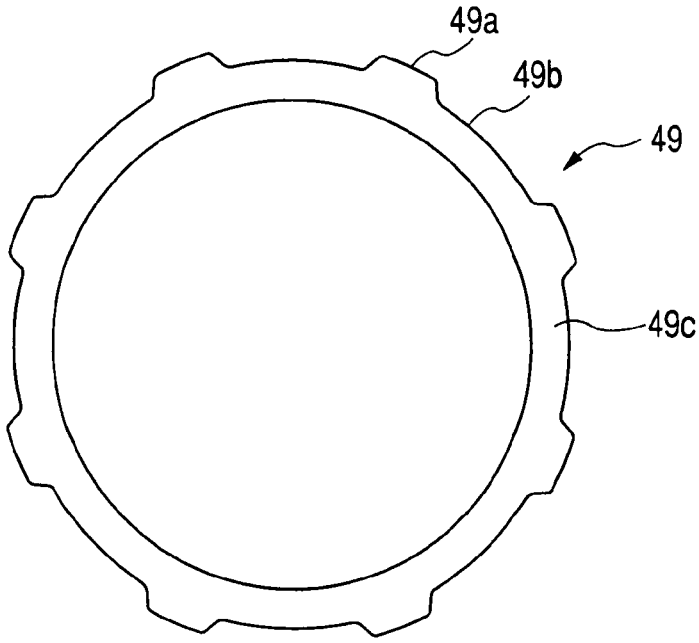
FIG. 3 is a plan view of a fixed disc of the impact absorbing device shown in FIG. 2.

FIG. 3 is a plan view of one fixed disc 49. As shown in FIG. 3, each fixed disc 49 has a ring-shaped body 49*c* and a plurality of projections 49*a* outwardly protruded from an outer circumferential portion of the body 49*c*. The projections 49*a* are engaged with the grooves 48*c* of the case 48 to prevent the fixed discs 49 from being rotated around the shaft 15. The inner diameter of the body 49*c* is almost equal to the inner diameter of the plate 48*a* of the case 48 so as not to collide with the planetary gears 27. Further, each fixed disc 49 has a plurality of dimples 49*b* on whole side surfaces of the body 49*c*, so that each of the surfaces acts as a frictional surface. The side surfaces of the body 49*c* are coated with a lubricant such as grease, and the dimples 49*b* hold the lubricant.

Figure 4:
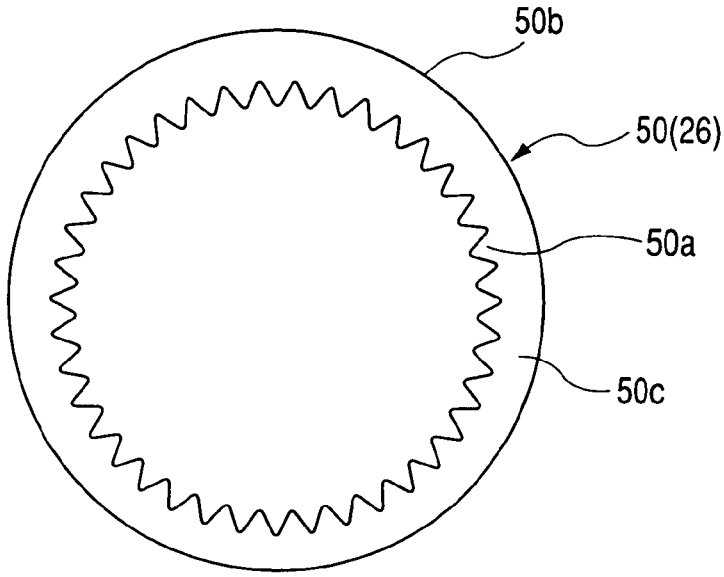
FIG. 4 is a plan view of a rotary disc of the impact absorbing device shown in FIG. 2.

FIG. 4 is a plan view of one rotary disc 50. As shown in FIG. 4, each rotary disc 50 has a ring-shaped body 50*c* and a plurality of gear teeth 50*a* placed on an inner circumferential surface of the body 50*c* along a circumferential direction of the discs. The outer diameter of the body 50*c* is slightly smaller than the inner diameter of the body 48*d* of the case 48, so that the rotary discs 50 can be rotated around the shaft 15. The teeth 50*a* mesh with teeth of the planetary gears 27 of the reducer 3 (see FIG. 2). Therefore, the internal gear 26 of the reducer 3 is constituted by the plural rotary discs 50. Further, each rotary disc 50 has a plurality of dimples 50*b* on whole side surfaces of the body 50*c*, so that each of the surfaces acts as a frictional surface. The side surfaces of the body 50*c* are coated with the lubricant, and the dimples 50*b* hold the lubricant. The frictional surfaces of the discs 49 and 50 adjacent to each other face each other through an oil film of the lubricant.

The springs 51 gives a load to a laminator of the discs 49 and 50 to produce a static friction and a sliding friction between the discs 49 and 50 adjacent to each other through an oil film of the lubricant. In this embodiment, the springs 51 and washers 53 are alternately disposed in two stages between the nuts 52 and the fixed disc 49. However, only a pair of spring 51 and washer 53 may be disposed in the device 4, or only one spring 51 may be disposed in the device 4 without any washer.

The nuts 52 adjust the load given from the springs 51 to the laminator of the discs 49 and 50 to obtain a suitable friction between the discs 49 and 50. When the nuts 52 are deeply inserted into the threads 48*b*, the load and the friction are increased.

Figure 5:
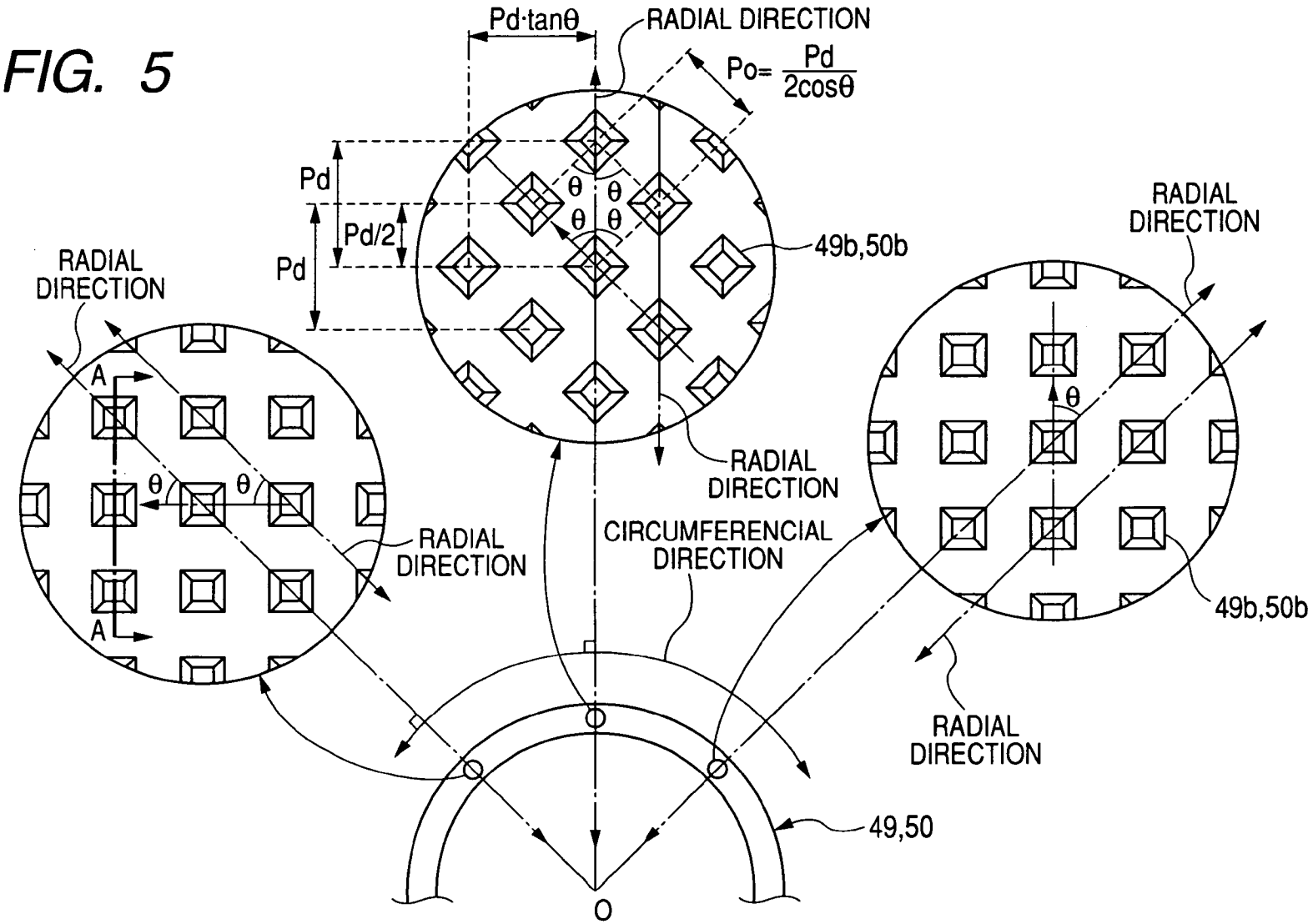
FIG. 5 is a partial plan view showing dimples of a disc representing the discs 49 and 50 according to the first embodiment.
Figure 6:
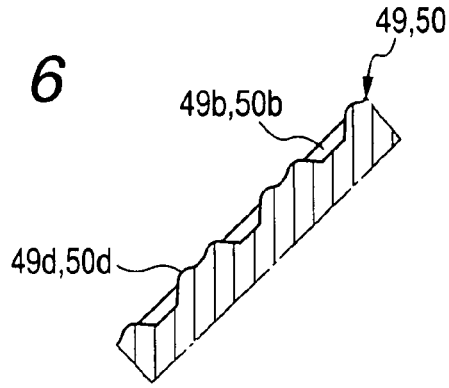
FIG. 6 is a sectional view taken substantially along line A-A of FIG. 5.

Next, the arrangement of the dimples 49*b* and 50*b* is described in detail with reference to FIG. 5 and FIG. 6. FIG. 5 is a partial plan view showing dimples of a disc representing the discs 49 and 50, while FIG. 6 is a sectional view taken substantially along line A-A of FIG. 5.

As shown in FIG. 5, the dimples 49*b* and 50*b* on the frictional surfaces have substantially the same shape and size. More specifically, each of the dimples 49*b* and 50*b* is formed by punching a surface of a metallic plate with a punch (not shown) formed in a square shape in section. Therefore, as shown in FIG. 6, each dimple is formed substantially in a frustum shape of a regular quadrangular pyramid and has a trapezoid in section. Further, when the metallic plate is punched, the plate substance punched is risen up around the dimple as a fluid matter. Therefore, each dimple 49*b* has a convex portion 49*d* risen up around the dimple, and each dimple 50*b* has a convex portion 50*d* risen up around the dimple.

The dimples 49*b* of each fixed disc 49 are regularly arranged on the frictional surface in a specific arranging pattern. More specifically, the dimples 49*b* of each fixed disc 49 forms a plurality of blocks aligned with one another along a circumferential direction of the disc 49 and forms a plurality of layers (from innermost layer to outermost layer) adjacent to one another along a radial direction of the discs perpendicular to the circumferential direction. The dimples 49*b* in each block are placed at the same position in the circumferential direction and are arranged at an equal pitch (or equal intervals) Pd along the radial direction. The dimples 49*b* in each layer are placed at the same position in the radial direction and are arranged at another equal pitch along the circumferential direction. The pitch in the dimples 49*b* of one layer is lengthened as the layer approaches the outermost layer.

Further, the positions of the dimples 49*b* of each block are, respectively, shifted in the radial direction by a distance of Pd/2 from the positions of the dimples 49*b* of any of two blocks adjacent to the each block. The dimples 49*b* of a middle layer are arranged at an equal pitch of Pd×tan θ ($0<\theta<90$ degrees, and $\theta=45$ degrees in this embodiment) along the circumferential direction. Therefore, in three middle layers, two dimples 49*b* disposed nearest each other in two blocks adjacent to each other are arranged at a pitch P0 ($P0=Pd/(2\cos\theta)$).

The dimples 50*b* of each rotary disc 50 are regularly arranged substantially in the same arranging pattern as the dimples 49*b* of the fixed disc 49 are arranged.

Further, each of the square-shaped dimples 49*b* and 50*b* has four sides on the frictional surface. An extending direction of two opposite sides of the dimple is inclined almost by the angle θ with respect to the radial direction such that two opposite sides of two dimples facing each other along an aligning direction inclined almost by the angle θ with respect to the radial direction become parallel to each other. For example, in this embodiment, each side of the dimple has a length of 0.5 mm, while the interval P0 between the dimples is set at 1.25 mm.

Although the dimples 50*b* of each rotary disc 50 have substantially the same arranging pattern, shape and size as the dimples 49*b* of any fixed disc 49 have, positions of the dimples 50*b* of each block in each rotary disc 50 are, respectively, differentiated in the radial direction from positions of the dimples 49*b* of any block of any fixed disc 49. In other words, a dimple position in the arranging pattern of the dimples 50*b* is shifted in the radial direction from a dimple position in the arranging pattern of the dimples 49*b*.

Figure 7A:
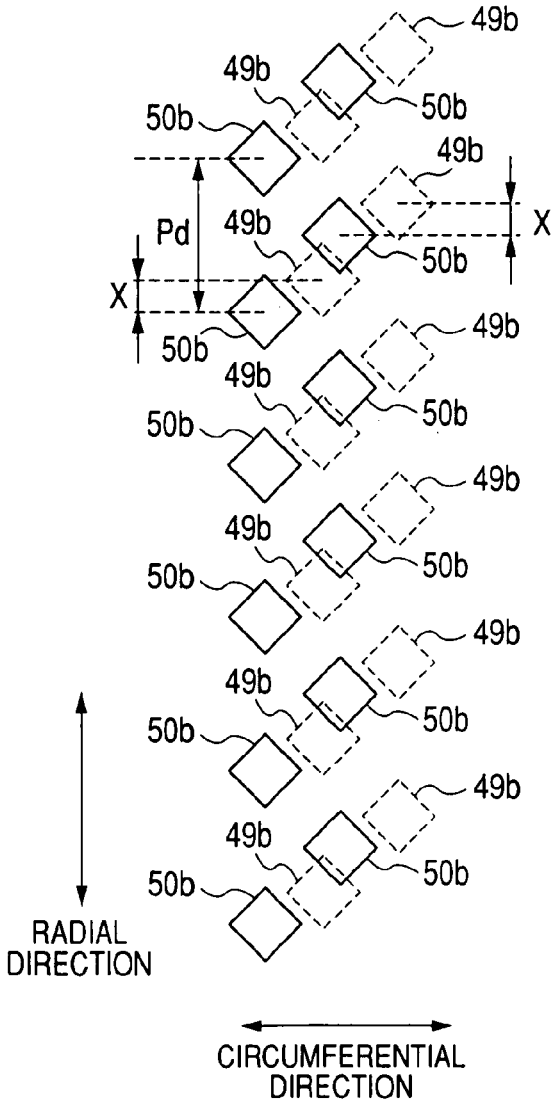
FIG. 7A is an enlarged plan view schematically showing a positional relation between two blocks of dimples of a rotary disc and two blocks of dimples of a fixed disc according to the first embodiment.
Figure 7B:
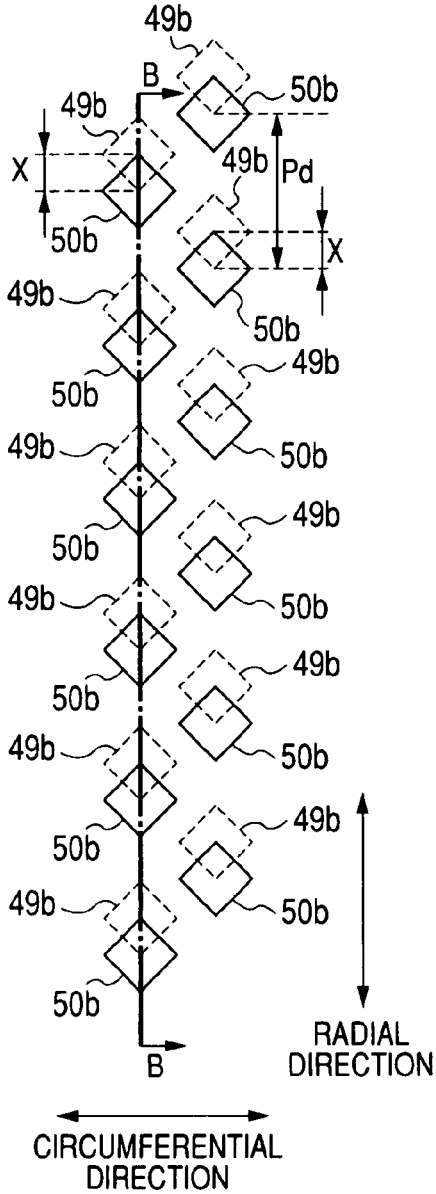
FIG. 7B is an enlarged plan view schematically showing two blocks of dimples of a rotary disc and two blocks of dimples of a fixed disc most approaching each other.
Figure 8:
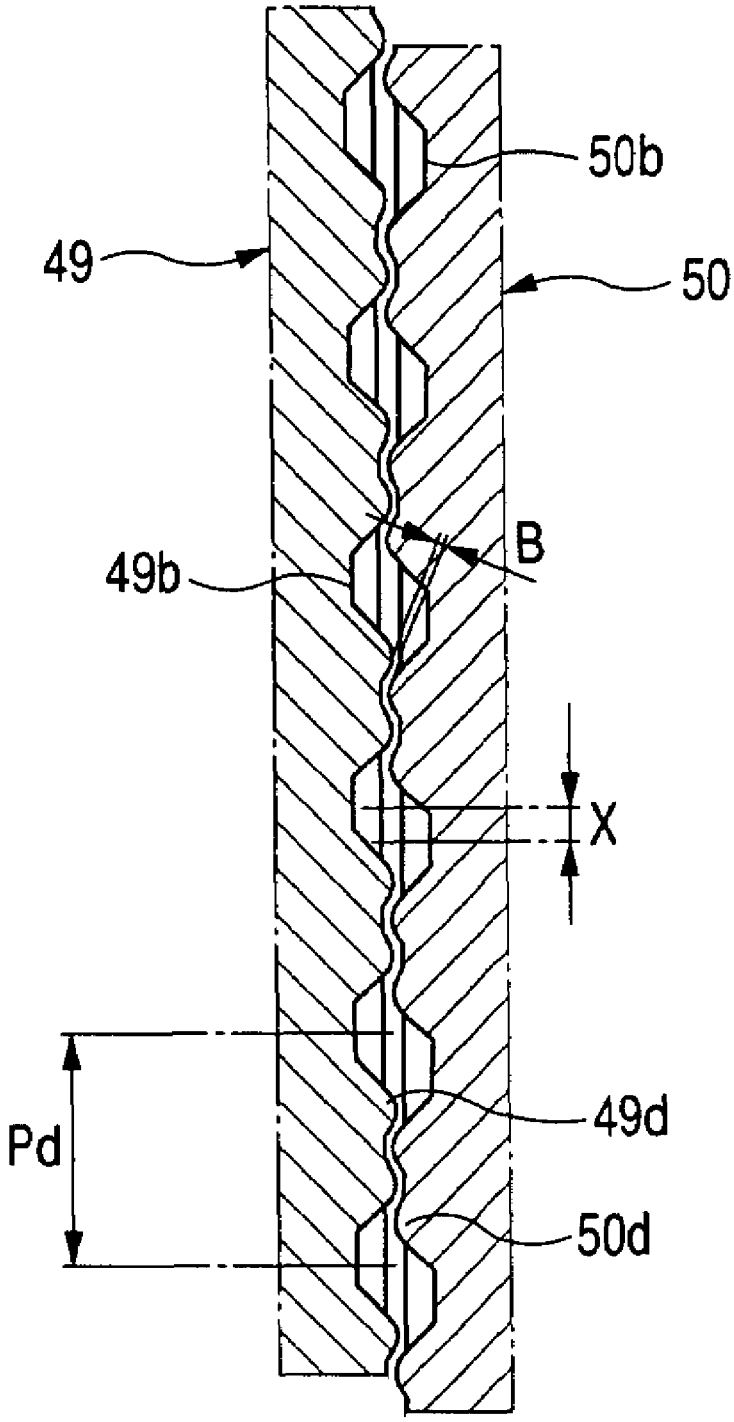
FIG. 8 is a sectional view of one fixed disc and one rotary disc taken substantially along line B-B of FIG. 7B.

This difference in the dimple arrangement between the discs 49 and 50 is described in more detail with reference to FIG. 7A, FIG. 7B and FIG. 8. FIG. 7A is an enlarged plan view schematically showing a positional relation between two blocks of dimples of a rotary disc and two blocks of dimples of a fixed disc, while FIG. 7B is an enlarged plan view schematically showing two blocks of dimples of a rotary disc and two blocks of dimples of a fixed disc most approaching each other. FIG. 8 is a sectional view of one fixed disc 49 and one rotary disc 50 taken substantially along line B-B of FIG. 7B.

As shown in FIG. 7A, positions of the dimples 50*b* of each block serially disposed along the radial direction are, respectively, differentiated in the radial direction (in this embodiment, a direction approaching the center of the disc 50) by an offset level X from positions of the dimples 49*b* of any block. A relation between the offset level X and the pitch Pd is set to satisfy an equation (1)

$$X=c1\times Pd \tag{1}$$

wherein the symbol c1 denotes a constant ranging from 0.1 to 0.5.

Each dimple 50*b* is movable along the circumferential direction. At a time each dimple 50*b* is placed at the same position in the circumferential direction as one dimple 49*b* is placed, as shown in FIG. 7B and FIG. 8, the dimples 50*b* most overlap with the dimples 49*b*.

With this structure of the device 4, when an impact force generated in the gear 7 (see FIG. 1) exceeds a predetermined level at the clanking time of the engine, the dimples 50*b* of each rotary disc 50 is moved along the circumferential direction of the disc 50 on two fixed discs 49 facing the disc 50. Because each of the dimples 49*b* and 50*b* has the convex portion 49*d* or 50*d* surrounding the dimple 49*b* or 50*b*, the convex portions 50*d* of the dimples 50*b* of each layer intend to periodically pass on the convex portions 49*d* of the dimples 49*b* of two layers adjacent to the each layer of the dimples 50*b* through an oil film of the lubricant.

However, the dimples 50*b* of each block are, respectively, shifted by the offset level X in the radial direction from the dimples 49*b* of any block. In this case, when the dimples 50*b* are moved along the circumferential direction in response to the rotation of the discs 50, most of the convex portions 50*d* pass on a specific area of the discs 49*b* on which no convex portions 49*d* exist. Therefore, a major part of the convex portions 49*d* and a major part of the convex portions 50*d* can reliably remain on the discs 49 and 50 without being worn out.

For example, as shown in FIG. 8, when each dimple 50*b* most approaches one dimple 49*b*, most of the convex portion 50*d* of the dimple 50*b* is placed between the convex portion 49*d* of the dimple 49*b* and the convex portion 49*d* of another adjacent dimple 49*b* or between a concavity of the dimple 49*b* and the convex portion 49*d* of the dimple 49*b*. Therefore, the dimple position difference in the radial direction between the discs 49 and 50 can prevent most of the convex portions 50*d* of the dimples 50*b* from directly coming in contact with the convex portions 49*d* of the dimples 49*b*, and the convex portion 50*d* of each dimple 50*b* can easily face the convex portion 49*d* of the dimple 49*b* through an open space of a gap distance G1. As a result, the convex portion 49*d* of each dimple 49*b* can stably face each of the convex portions 50*d* of the dimples 50*b* through an open space filled with the lubricant, and the convex portions 49*d* and 50*d* of the dimples 49*b* and 50*b* can reliably remain on the discs 49 and 50.

Further, when the offset level X is set to be equal to or larger than a length of 0.1×Pd, most of the convex portion 50*d* of each dimple 50*b* approaching one dimple 49*b* can reliably be placed out of the convex portion 49*d* of the dimple 49*b*. When the offset level X is set to be equal to or smaller than a length of 0.5×Pd, most of the convex portion 50*d* of each dimple 50*b* approaching one dimple 49*b* can reliably be placed out of the convex portion 49*d* of another dimple 49*b* adjacent to the one dimple 49*b* in the radial direction. Therefore, it is preferred that the constant c1 be ranged from 0.1 to 0.5.

Accordingly, abrasive resistance of the discs 49 and 50 can be heightened or improved, the life of the impact absorbing device 4 can be prolonged, and the impact absorbing device 4 can reliably absorb an impact for a long time.

Further, because the discs 49 and 50 face each other at least at the gap distance G1, the convex portions 49*d* and 50*d* can be maintained for a long time without being worn out. Accordingly, a change in friction factor between the discs 49 and 50 can be suppressed, so that a sliding torque of the rotary discs 50 corresponding to the sliding friction can be stabilized so as to stably rotate the rotary discs 50.

Moreover, because each dimple is surrounded by the convex portion hardly worn out, the dimples of each disc can sufficiently hold a lubricant coated on the disc for a long time. Accordingly, the discs 49 and 50 can stably face each other through an oil film of the lubricant for a long time so as to prolong the life of the device 4.

In this embodiment, each side of each dimple 49*b* or 50*b* is extended in the same direction as one side of another dimples 49*b* or 50*b* is extended. However, one side of each dimple 49*b* or 50*b* may be extended in a direction different from that of any side of another dimple 49*b* or 50*b*. In other words, each side of each dimple 49*b* or 50*b* may be extended in an arbitrary direction.

Further, in this embodiment, each dimple 49*b* or 50*b* is formed in a square shape on the corresponding frictional surface. However, each dimple may be formed in an arbitrary shape such as a triangular shape, a circular shape, an oval shape or the like.

Moreover, the dimples 49*b* or 50*b* in each disc 49 or 50 may be differentiated from one another in size.

Furthermore, in this embodiment, the positions of the dimples 49*b* or 50*b* of each block in the radial direction, respectively, differ by the distance of Pd/2 from the positions of the dimples 49*b* or 50*b* of any of two blocks adjacent to the each block. However, the dimples 49*b* or 50*b* of each block may be placed at the same positions in the radial direction as the dimples 49*b* or 50*b* of any of the other blocks are placed (θ=0 or 90 degrees).

Further, in this embodiment, dimples 49*b* or 50*b* of each block are serially arranged along the radial direction. However, dimples 49*b* or 50*b* of each block may be arranged in zigzags in the radial direction.

Moreover, in this embodiment, the blocks of dimples 49*b* or 50*b* selected from the dimples 49*b* or 50*b* of each disc 49 or 50 every two blocks are placed at the same position in the radial direction. However, dimples 49*b* or 50*b* of each block may be placed at different positions in the radial direction from the positions of the dimples 49*b* or 50*b* of any of the other blocks, on condition that positions of the dimples 50*b* of each block in the radial direction are, respectively, differentiated from positions of the dimples 49*b* of any block.

Furthermore, in this embodiment, the dimples 49*b* or 50*b* of each block are arranged at the equal pitch in the radial direction. However, the dimples 49*b* or 50*b* of each block are arranged at different pitches in the radial direction. Further, the dimples 49*b* or 50*b* of each layer are arranged at different pitches in the circumferential direction.

Still further, each dimple 49*b* or 50*b* of each block is placed just at the mid-position between two adjacent dimples 49*b* or 50*b* of an adjacent block in the radial direction. However, each dimple 49*b* or 50*b* of each block may be placed at an arbitrary position between two adjacent dimples 49*b* or 50*b* of an adjacent block in the radial direction.

Embodiment 2

In the first embodiment, the dimples 50*b* of each rotary disc 50 are disposed at the same equal pitch Pd in the radial direction as the dimples 49*b* of any fixed disc 49 are disposed, and a dimple position in the arranging pattern of the dimples 50*b* is shifted in the radial direction from a dimple position in the arranging pattern of the dimples 49*b*. However, the pitch of the dimples 50*b* in the radial direction may be differentiated from that of the dimples 49*b* to shift the dimples 50*b* from the dimples 49*b* in the radial direction.

Figure 9A:
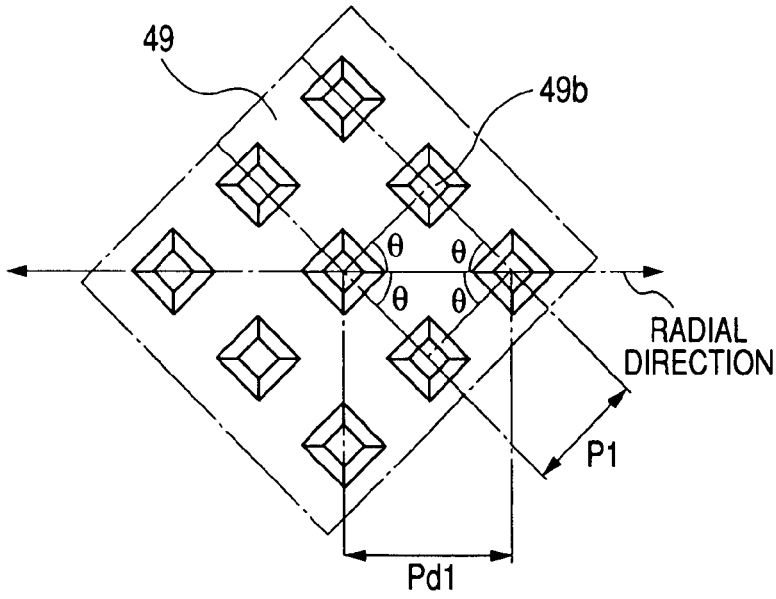
FIG. 9A is a partial plan view of a fixed disc of the device according to a second embodiment.
Figure 9B:
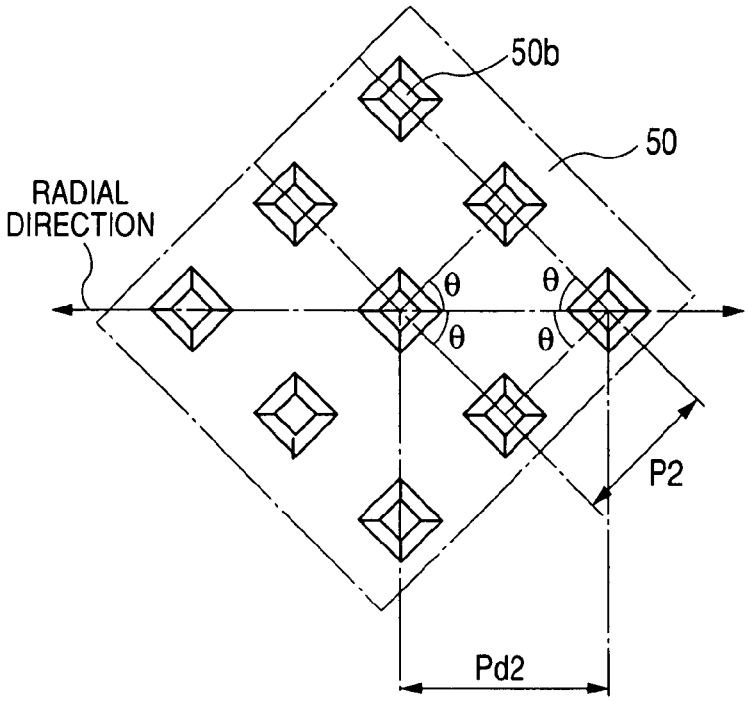
FIG. 9B is a partial plan view of a rotary disc of the device according to the second embodiment.

FIG. 9A is a partial plan view of one fixed disc 49 according to the second embodiment, while FIG. 9B is a partial plan view of one rotary disc 50 according to the second embodiment.

As shown in FIG. 9A and FIG. 9B, the dimples 49*b* of each fixed disc 49 are regularly disposed in the same manner as in the first embodiment. That is, the dimples 49*b* are arranged to form a plurality of blocks aligned with one another along the circumferential direction and to form a plurality of layers aligned with one another along the radial direction. The dimples 49*b* in each block are placed at the same position in the circumferential direction. The dimples 50*b* of each rotary disc 50 are disposed substantially in the same arranging pattern as the dimples 49*b* of any fixed disc 49 are disposed.

Further, the dimples 49*b* of each fixed disc 49 are arranged at an equal pitch Pd1. In contrast, the dimples 50*b* of each rotary disc 50 are arranged at another equal pitch Pd2 (Pd1≠Pd2) differing from the pitch Pd1. The dimples 49*b* in each layer are arranged at an equal pitch of almost Pd1×tan θ along the circumferential direction, so that the dimples 49*b* are arranged almost at a pitch P1 (P1=Pd1/(2 cos θ)) along each of aligning lines inclined almost by the angle θ with respect to the radial direction. The dimples 50*b* in each layer are arranged at an equal pitch of almost Pd2×tan θ along the circumferential direction, so that the dimples 49*b* are arranged almost at a pitch P2 (P2=Pd2/(2 cos θ), P2≠P1)

along each of aligning lines inclined almost by the angle θ with respect to the radial direction.

The pitches P1 and P2 satisfy an equation (2) or an equation (3):

$$P1=c2\times P2 \quad (2)$$

$$P2=c2\times P1 \quad (3)$$

wherein the symbol c2 denotes a constant ranging from 1.1 to 1.5. Therefore, the pitches Pd1 and Pd2 satisfy the relation of Pd1=c2×Pd2 or the relation of Pd2=c2×Pd1. The pitches P1 and P2 shown in FIG. 9A and FIG. 9B satisfy the equation (3).

With this structure of the device 4, because the pitches Pd1 and Pd2 (Pd1≠Pd2) defined in the radial direction differ from each other, there is a high probability that the dimples 50*b* of each layer are shifted in the radial direction from the dimples 49*b* of any of two layers placed near the each layer of dimples 50*b*. For example, to effectively differentiate the positions of the dimples 50*b* of each layer in the radial direction from the positions of the dimples 49*b* of any layer, it is required that the constant c2 is equal to or larger than 1.1. To arrange each of the group of dimples 49*b* and the group of dimples 50*b* in one frictional surface at a moderate density, it is required that the constant c2 is equal to or smaller than 1.5.

During the rotation of the rotary discs 50, a probability that the convex portions 50*d* of the dimples 50*b* directly come in contact with the convex portions 49*d* of the dimples 49*b* is lowered. That is, even though a minor part of the convex portions 50*d* of the dimples 50*b* directly come in contact with the convex portions 49*c* of the dimples 49*b*, most of the convex portions 50*d* of the dimples 50*b* pass on an area on which no convex portions 49*d* exist. Therefore, even though each rotary disc 50 is rotated on its axis on the adjacent fixed discs 49 for a long time to absorb an impact force, most of the convex portions 49*d* and most of the convex portions 50*d* reliably remain in the discs 49 and 50 so as to stabilize a slipping torque of the rotary discs 50.

Accordingly, because the direct contact of the rotary discs 50 with the fixed discs 49 through no lubricant can be reduced, and the impact absorbing device 4 can reliably absorb an impact for a long time while stabilizing a slipping torque of the rotary discs 50.

Embodiment 3

In the first and second embodiments, the dimples 49*b* of each block are arranged along the radial direction, and the dimples sob of each block are arranged along the radial direction. However, the dimples sob of each block may be arranged along an aligning direction different from the radial direction, while the dimples 49*b* of each block are arranged along the radial direction.

Figure 10A:
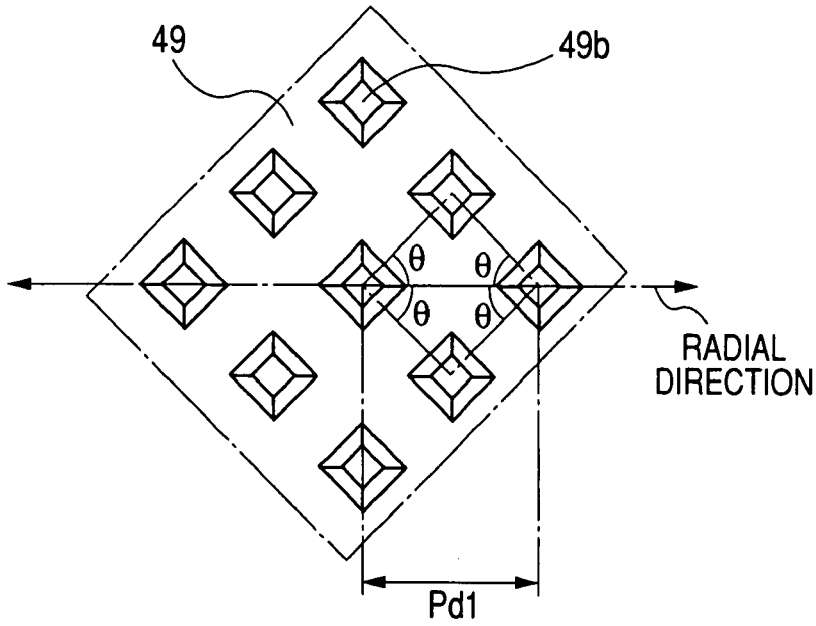
FIG. 10A is a partial plan view of a fixed disc of the device according to a third embodiment.
Figure 10B:
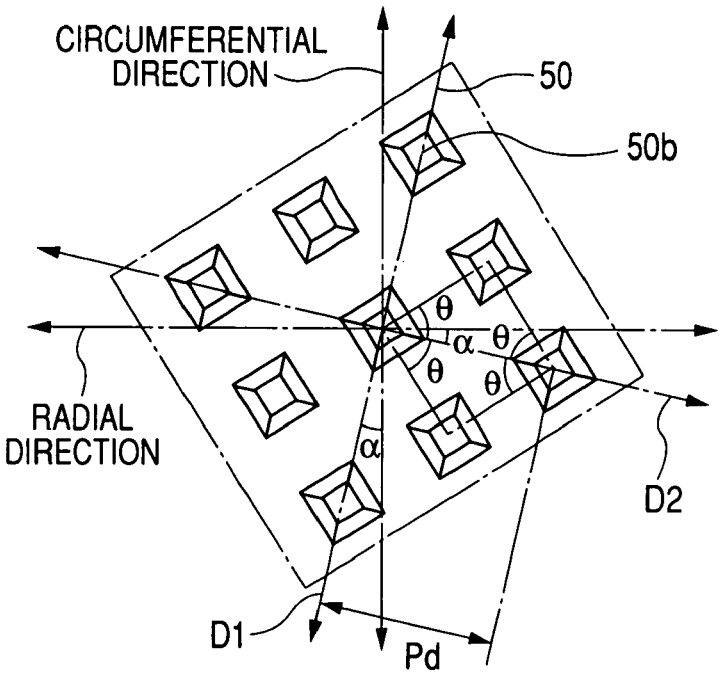
FIG. 10B is a partial plan view of a rotary disc of the device according to the third embodiment.

FIG. 10A is a partial plan view of one fixed disc 49 according to the third embodiment, while FIG. 10B is a partial plan view of one rotary disc 50 according to the third embodiment.

As shown in FIG. 10A and FIG. 10B, the dimples 49*b* of the fixed discs 49 are disposed on each frictional surface in the same arranging pattern as the dimples 49*b* of the fixed discs 49 are disposed according to the first embodiment. In contrast, the dimples 50*b* of each rotary disc 50 are arranged to form a plurality of blocks aligned with one another along a first aligning direction D1 inclined by an angle α (0<α<45 degrees) with respect to the circumferential direction and to form a plurality of layers aligned with one another along a second aligning direction D2 inclined by the angle α with respect to the radial direction. The first and second aligning directions are perpendicular to each other.

The dimples 50*b* in each block are placed at the same position in the first aligning direction D1 and are arranged along the second aligning direction D2 at the same equal pitch Pd as the dimples 49*b* in each block are arranged along the radial direction. The dimples 50*b* in each layer are placed at the same position in the second aligning direction D2 and are arranged along the first aligning direction D1 at the same equal pitch Pd×tan θ as the dimples 49*b* in each layer are arranged along the circumferential direction.

With this structure of the device 4, an extending direction of each block of dimples sob differs from an extending direction of each block of dimples 49*b* by the angle α. Therefore, although the dimples 50*b* in each block are arranged at the same equal pitch Pd as the dimples 49*b* in each block are arranged, positions of the dimples 50*b* in each block in the radial direction are, respectively, differentiated from positions of the dimples 49*b* in any block. Therefore, when each dimple sob is moved along the circumferential direction perpendicular to the radial direction, a probability that the convex portions 50*d* of the rotary discs 50 are directly in contact with the convex portions 49*d* of the fixed discs 49 is lowered. That is, even though a minor part of the convex portions 50*d* of the dimples 50*b* directly come in contact with the convex portions 49*c* of the dimples 49*b*, most of the convex portions 50*d* of the dimples 50*b* pass on an area on which no convex portions 49*d* exist. Therefore, even though the device 4 is used in the starter 1 for a long time to absorb an impact force, most of the convex portions 49*d* and most of the convex portions 50*d* reliably remain in the discs 49 and 50 so as to stabilize a slipping torque of the rotary discs 50.

Accordingly, because the direct contact of the rotary discs 50 with the fixed discs 49 through no lubricant can be reduced, and the impact absorbing device 4 can reliably absorb an impact for a long time while stabilizing a slipping torque of the rotary discs 50.

In this embodiment, the dimples 49*b* of the fixed discs 49 are disposed in the same manner as in the first embodiment. However, the dimples 49*b* of each fixed disc 49 may be arranged to form a plurality of blocks aligned with one another along an aligning direction inclined by an angle β (β≠α, 0<β<45 degrees) with respect to the circumferential direction and to form a plurality of layers aligned with one another along another aligning direction inclined by the angle β with respect to the radial direction. With this structure, because of the relation β≠α, even when the dimples 50*b* in each block are arranged at the same equal pitch Pd as the dimples 49*b* in each block are arranged, positions of the dimples 50*b* in each block in the radial direction can be, respectively, differentiated from positions of the dimples 49*b* in any block.

Modifications

In the first embodiment, the dimples 50*b* of each rotary disc 50 are regularly disposed in the same arranging pattern as the dimples 49*b* of any fixed disc 49 are regularly disposed. However, the arranging pattern of the dimples 50*b* may be differentiated from that of the dimples 49*b*. In this case, even though the dimples 50*b* have the same shape and size as the dimples 49*b* have, a probability that the convex portion 50*d* of each dimple 50*b* moved along the circumferential direction periodically overlaps with each of the convex portions 49*d* of the dimples 49*b* is lowered.

Figure 11:
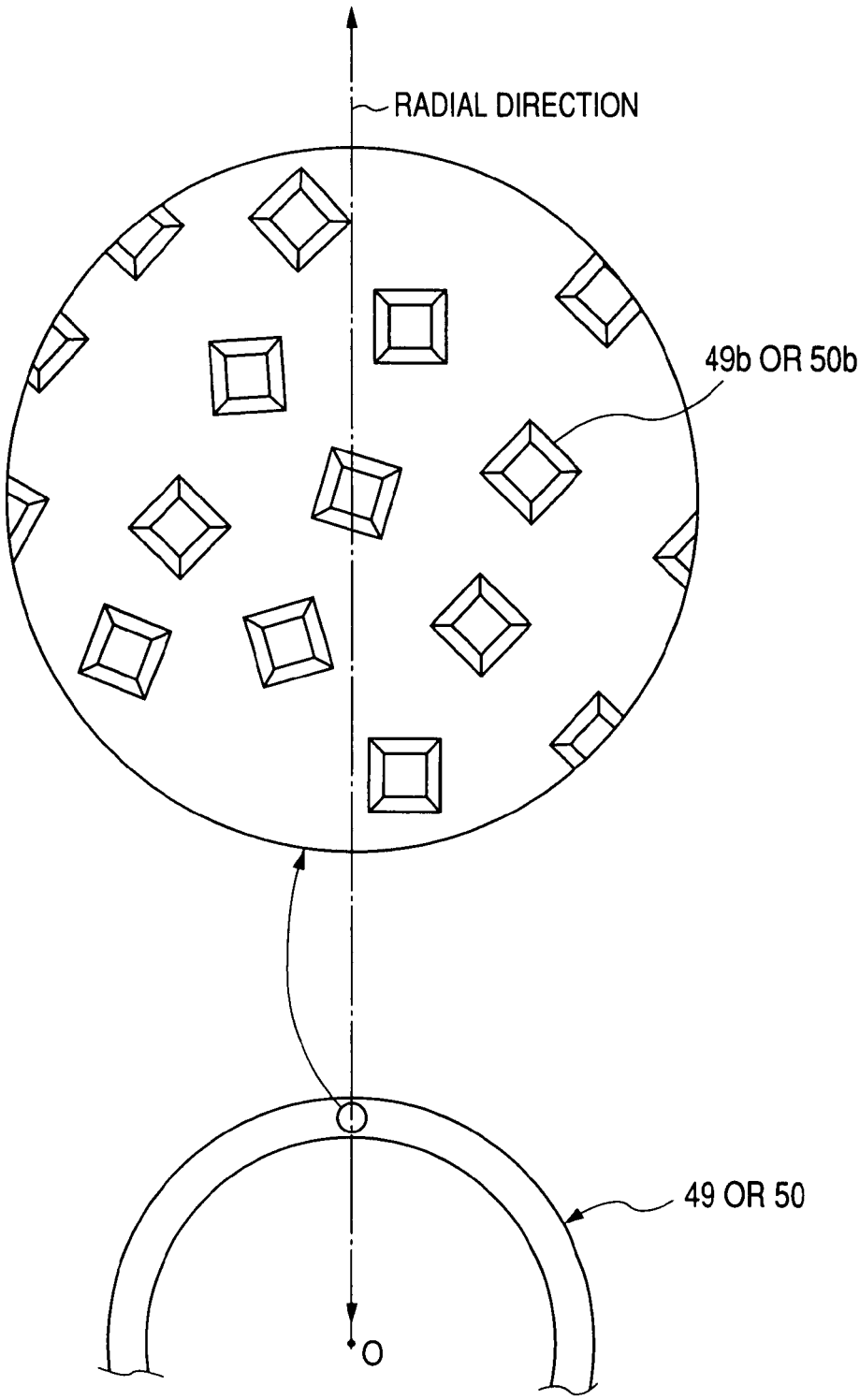
FIG. 11 is a partial plan view showing dimples of a disc randomly disposed according to a modification of the first embodiment.

For example, as shown in FIG. 11, the dimples 49*b* in each fixed disc 50 and/or the dimples 50*b* in each rotary disc 50 may be randomly disposed on the corresponding frictional surface. With this structure, none of the dimples 50*b* periodically overlap with the dimples 49*b*, so that a direct contact of the convex portions 50*d* with the convex portions 49*d* through no lubricant can be reduced.

In the first to third embodiments, the device 40 has the plurality of fixed discs 49 and the plurality of rotary discs 50 alternately disposed, and each disc has two frictional surfaces. However, the device 40 having a single fixed disc with a single frictional surface and a single rotary disc with a single frictional surface can reduce an impact force when the frictional surfaces face each other.

Further, even when no lubricant or the like is disposed between the frictional surfaces of the discs 49 and 50, the device 40 can reduce an impact force. Particularly, when the dimples 49*b* and 50*b* are disposed on the frictional surfaces of the discs 49 and 50 according to one of the first to third embodiments, abrasive resistance of the discs 49 and 50 can be heightened or improved, and the life of the device 4 can be prolonged.

What is claimed is:

1. An impact absorbing device, comprising:

a fixed disc with a first frictional surface; and a rotary disc with a second frictional surface so as to coaxially face the first frictional surface of the fixed disc, the rotary disc being rotatable on the fixed disc against a frictional force between the fixed disc and the rotary disc in response to a load torque given to the rotary disc as an impact force, wherein the fixed disc has a plurality of first dimples on the first frictional surface, the rotary disc has a plurality of second dimples on the second frictional surface, each of the second dimples being movable along a circumferential direction of the discs in response to the load torque, a position of each of the second dimples is differentiated from a position of any of the first dimples in a radial direction of the discs substantially perpendicular to the circumferential direction, and the first dimples are arranged on the first frictional surface to form a plurality of blocks aligned with one another along the circumferential direction such that the first dimples of each block are arranged substantially at an equal pitch Pd along the radial direction, the second dimples are arranged on the second frictional surface to form a plurality of blocks aligned with one another along the circumferential direction such that the second dimples of each block are arranged along the radial direction at the same equal pitch Pd as the first dimples are arranged, and the positions of the second dimples of each block are, respectively, differentiated in the radial direction by a shift value X from the positions of the first dimples of any block so as to satisfy a relation:

$$X=c\times Pd$$

wherein a constant c ranges from 0.1 to 0.5.

2. The device according to claim 1, wherein each of the first and second dimples has a concave portion around the dimple such that positions of the concave portions of the second dimples are differentiated in the radial direction from those of the concave portions of the first dimples.

3. The device according to claim 1, wherein a combination of the fixed disc and the rotary disc rotated on the fixed disc is adapted to absorb the impact force added to the rotary disc when a starter starts a driving operation of an internal combustion engine.

4. The device according to claim 1, further comprising a lubricant disposed between the first frictional surface of the fixed disc and the second frictional surface of the rotary disc, wherein the rotary disc is adapted to be rotated on the fixed disc through the lubricant.

5. The device according to claim 1, wherein the first dimples have substantially the same shape or size as the second dimples have.

6. An impact absorbing device, comprising:

a fixed disc with a first frictional surface; and a rotary disc with a second frictional surface so as to coaxially face the first frictional surface of the fixed disc, the rotary disc being rotatable on the fixed disc against a frictional force between the fixed disc and the rotary disc in response to a load torque given to the rotary disc as an impact force, wherein the fixed disc has a plurality of first dimples on the first frictional surface, the rotary disc has a plurality of second dimples on the second frictional surface, each of the second dimples being movable along a circumferential direction of the discs in response to the load torque, a position of each of the second dimples is differentiated from a position of any of the first dimples in a radial direction of the discs substantially perpendicular to the circumferential direction, wherein the first dimples are arranged on the first frictional surface to form a plurality of blocks aligned with one another along the circumferential direction such that the first dimples of each block are arranged at different pitches along the radial direction, the second dimples are arranged on the second frictional surface to form a plurality of blocks aligned with one another along the circumferential direction such that the second dimples of each block are arranged along the radial direction at the same different pitches as the first dimples are arranged, and the positions of the second dimples of each block are, respectively, differentiated in the radial direction from the positions of the first dimples of any block.

7. An impact absorbing device, comprising:

a fixed disc having a first frictional surface; and a rotary disc having a second frictional surface coaxially facing the first frictional surface of the fixed disc, the rotary disc being rotatable on the fixed disc against a frictional force between the fixed disc and the rotary disc in response to a load torque given to the rotary disc as an impact force, wherein the fixed disc has a plurality of first dimples on the first frictional surface, the rotary disc has a plurality of second dimples on the second frictional surface, each of the second dimples being movable along a circumferential direction of the discs in response to the load torque, and the first dimples have a shape or size differentiated from a shape or size of the second dimples to differentiate a position of a part of each second dimple in a radial direction of the discs perpendicular to the circumferential direction from a position of any of the first dimples.

8. The device according to claim 7, wherein the shape and size of the first dimples are differentiated from the shape and size of the second dimples.

9. The device according to claim 7, wherein each of the first and second dimples has a concave portion around the dimple such that positions of the concave portions of the second dimples are differentiated in the radial direction from those of the concave portions of the first dimples.

10. The device according to claim 7, wherein a combination of the fixed disc and the rotary disc rotated on the fixed disc is adapted to absorb the impact force added to the rotary disc when a starter starts a driving operation of an internal combustion engine.

11. The device according to claim 7, further comprising a lubricant disposed between the first frictional surface of the fixed disc and the second frictional surface of the rotary disc, wherein the rotary disc is adapted to be rotated on the fixed disc through the lubricant.

* * * * *